United States Patent [19]

Nonni

[11] Patent Number: 4,568,420

[45] Date of Patent: Feb. 4, 1986

[54] MULTI-STAGE BLEACHING PROCESS INCLUDING AN ENHANCED OXIDATIVE EXTRACTION STAGE

[75] Inventor: Arthur J. Nonni, River Edge, N.J.

[73] Assignee: International Paper Company, New York, N.Y.

[21] Appl. No.: 677,657

[22] Filed: Dec. 3, 1984

[51] Int. Cl.[4] ..... D21C 9/14; D21C 9/147; D21C 9/16

[52] U.S. Cl. ..... 162/65; 162/78; 162/89; 162/90

[58] Field of Search ..... 162/88, 89, 65, 78, 162/90

[56] References Cited

U.S. PATENT DOCUMENTS

| | | | |
|---|---|---|---|
| 2,587,064 | 2/1952 | Rapson | 8/105 |
| 2,962,413 | 11/1960 | Hatheway | 162/89 |
| 3,345,250 | 10/1967 | Brinkley et al. | 162/78 |
| 3,817,825 | 6/1974 | Conca et al. | 162/89 |
| 3,832,276 | 8/1974 | Roymoulik et al. | 162/65 |
| 4,081,317 | 3/1978 | Gall et al. | 162/80 |
| 4,274,912 | 6/1981 | Carles et al. | 162/41 |
| 4,451,332 | 5/1984 | Annergren et al. | 162/89 |
| 4,462,864 | 7/1984 | Carles et al. | 162/78 |

OTHER PUBLICATIONS

Chan et al., "Modified Bleaching Sequences", *Pulp & Paper Canada;* 86:1 (1985) presented Montreal Jan. 31--Feb. 4, 1983.

Enz and Hallenback, "$E_o$ Provides Opportunity for Splitting Existing Bleach Plant", TAPPI Proceedings, 1983 Pulping Conference, pp. 309-313.

Larsen and Partridge, "Bleaching of Pulp, Chapter 5—Bleaching with Hypochlorites, Tappi Press, 1979, pp. 109-110.

Reeve, Tappi; 67(4), 143(1984).

*Primary Examiner*—Steve Alvo

*Attorney, Agent, or Firm*—Jay S. Cinamon

[57] ABSTRACT

A multi-stage process for the delignification and bleaching of lignocellulosic pulp is disclosed wherein the first alkaline extraction stage comprises extracting the pulp with caustic in the presence of oxygen and either a hypochlorite or a peroxide.

26 Claims, No Drawings

MULTI-STAGE BLEACHING PROCESS INCLUDING AN ENHANCED OXIDATIVE EXTRACTION STAGE

FIELD OF THE INVENTION

The present invention relates to a process for the delignification and brightening of lignocellulosic pulp. More particularly, it relates to a material improvement in a lignocellulosic pulp bleaching sequence employing oxygen during the alkaline extraction stage.

BACKGROUND OF THE INVENTION

The conventional method for delignifying and bleaching lignocellulosic pulp has been to employ a variety of multi-stage bleaching sequences, for example, 4, 5, or 6 stages, which traditionally have been based on the use of chlorine and/or chlorine dioxide in the bleaching or brightening stages.

In practice, intermediate alkaline extraction stages with caustic are used between the chlorination and bleaching stages. When applied immediately following the chlorination stage, denoted as CE, the first alkaline extraction stage is used to solubilize and remove a major portion of the chlorinated and oxidized residual lignin (chlorolignin) that is retained in the chlorination stage pulp, remove fatty acid-esters and resins present in the pulp, and also remove hemicellulose. It is an integral part of any multi-stage bleaching sequence. The resultant chlorinated-extracted pulp contains only 0.5% to 1.0% residual lignin which is amenable to further oxidation and brightening in later stages without excessive bleach chemical usage. However, while the alkaline extraction stage prepares pulp for subsequent bleaching, its immediate effect is to darken the remaining pulp impurities relative to chlorinated pulp.

With the advent of stricter environmental regulations designed to abate water and air pollution problems associated with chlorine—containing bleaching chemicals, coupled with their high cost and extensive recovery systems needed for their removal from the effluent streams, the paper industry has directed its attention to other bleaching chemicals which might avoid these problems.

One of the major areas of research and development in the last number of years has been directed to the use of oxygen as a delignifying agent and bleachant in various pulp bleaching sequences. One bleaching innovation that has been widely acclaimed is the use of oxygen in conjunction with a conventional alkaline extraction stage, denoted as Eo, immediately following a chlorination stage. It has achieved widespread commercial implementation in the last number of years. D. W. Reeve in TAPPI: 67(4), 143 (1984) provides a partial tabulation of worldwide Eo installations, and Enz and Hallenbeck presented a detailed description of the effects an Eo-stage has on bleach plant operations and pulp quality (1983 Pulping Conference, Houston, Tex., November 1983, pp. 309–313).

The principle action of oxygen in an alkaline extraction stage is to partially delignify and brighten the pulp compared to a conventional non-oxygen reinforced caustic extraction. Typically, in mill practice, the lignin content of the pulp is decreased by 18–25% of the lignin normally remaining in a conventional softwood kraft pulp subsequent to a CE treatment, as measured by Tappi standard method T214. In the case of hardwood kraft pulps, the delignification usually does not exceed a 15–20% decrease in lignin content when compared with a conventional CE bleached pulp. The brightness of both softwood and hardwood pulps is increased by about 4–6% GE points when an oxygenated alkaline extraction stage is employed compared to an alkaline extraction stage in which oxygen is not used.

While the use of oxygen in an alkaline extraction stage materially increases delignification and brightness, it adversely affects pulp viscosity which represents a drawback to its use. Typically, a softwood or hardwood kraft pulp extracted in the presence of oxygen has a viscosity which is 2–3 cps lower than a pulp which has been conventionally extracted.

Accordingly, it is an object of the present invention to provide a method for increasing the amount of delignification and brightening provided by an oxygen-alkaline extraction stage (Eo) without incurring additional viscosity losses.

SUMMARY OF THE INVENTION

The foregoing object, and other objects which will be apparent to those skilled in the art, is accomplished by adding a hypochlorite or a peroxide together with oxygen during the first alkaline extraction stage with caustic of a multi-stage bleaching and delignification process, or by adding a hypochlorite or a peroxide directly to the pulp immediately prior to the first alkaline extraction stage with caustic and oxygen in a multi-stage bleaching and delignification process. For the purposes of this specification and the appended claims, the alternate modes of addition of hypochlorite or peroxide which are described above, and which shall be described hereinafter in greater detail, shall be deemed to be equivalent and comprise but a single stage, namely, the first alkaline extraction stage in a multi-stage bleaching and delignification process.

The process of the present invention has a number of advantages over the practices of the prior art. It provides additional delignification and brightening in an extraction stage beyond that attainable by either $C_D$(hE), $C_D$(pE) or $C_DE_o$ alone and, most unexpectedly, without any additional loss in viscosity beyond that obtained when using any of the foregoing sequences at comparable permanganate numbers. As used herein, (hE) is used to denote the use of hypochlorite followed by an alkaline extraction without an intervening washing stage. Similarly, the use of (pE) herein is to denote the use of peroxide followed by an alkaline extraction without an intervening washing stage.

This is especially noteworthy with regard to hypochlorite since it is not considered to be a lignin-specific bleaching agent and its use always results in some attack on cellulose regardless of the pH. Moreover, the use of hypochlorite or peroxide in the first alkaline extraction stage is regarded as being an ineffective means of bleaching pulp fiber compared to its use in subsequent bleaching stages. Furthermore, the process of the present invention also serves to reduce hypochlorite or chlorine-dioxide usage downstream in the bleaching process and thus effect a significant saving in chemical usage.

While not wishing to be bound or limited by any theory, it is postulated that either: (1) the hypochlorite or the peroxide activate the chlorolignins in the pulp thereby rendering them more amenable to further bleaching without attacking the cellulosic portion of the pulp; or (2) there is an unknown reaction between the hypochlorite or peroxide and oxygen which is lignin selective and thus minimizes damage to the cellulosic portion of the pulp.

DETAILED DESCRIPTION OF THE INVENTION

In accordance with the process of the present invention, an aqueous northern or southern hardwood or softwood kraft pulp may be employed. While it is preferred to employ a kraft pulp, other chemically digested pulps may be used, such as soda, sulfite, semi-chemical, soda-anthraquinone, etc. The consistency of the pulp can be from about 0.1% to about 30%, based on the oven-dry weight of the pulp. A consistency of from about 1% to about 15% is preferred, with a consistency of from about 3% to about 12% being especially preferred.

Typically, in the first or initial delignification and bleaching stage subsequent to digestion, the pulp is first chlorinated, using either chlorine, chlorine dioxide, or a mixture of chlorine and chlorine dioxide, at a temperature of from about 30° C. to about 75° C. for about 1 minute to about 60 minutes. The consistency of the pulp after chlorination can be from about 1% to about 10%. Alternatively, in the first bleaching stage the pulp can also be treated with ozone, oxygen or with acid peroxide. Further, in accordance with the process of the present invention the bleaching and delignification chemicals listed above can also be used alone or in various combinations, if it is so desired, in one or more stages following the initial stage, provided that the initial extraction stage is operated in accordance with the process of the present invention.

Thereafter, the pulp is washed using a drum washer or other suitable washing apparatus, steamed in a steam mixer, and subjected to a first alkaline extraction with caustic, preferably sodium hydroxide, or other suitable alkaline extractants such as potassium hydroxide or sodium carbonate, at a consistency of from about 3% to about 15%, based on O.D. weight of the pulp, at a temperature between about 40° C. and about 80° C., for a retention period of from about 3 minutes to about 120 minutes, using a quantity of sodium hydroxide corresponding to a % sodium hydroxide to % chlorine ratio, based on the oven-dry weight of the pulp, of between about 0.35 and about 0.65.

In accordance with the process of the present invention, from about 0.2% to about 1.0% of oxygen, based on the oven-dry (O.D.) weight of the pulp, is added during the alkaline extraction stage. It is preferred to employ from about 0.4% to about 0.6% oxygen, based on O.D. pulp. Simultaneous with the addition of the oxygen, either sodium hypochlorite or calcium hypochlorite, or alternatively hydrogen peroxide, sodium peroxide, other inorganic peroxides, or organic peroxides, or compounds which in situ produce peroxides, is added during the alkaline extraction stage.

It is preferred to employ either sodium hypochlorite or hydrogen peroxide at an application level of from about 0.05% to about 1.0%, based on O.D. pulp, and preferably, at an application level of from about 0.05% to about 0.5%, based on O.D. pulp.

Such an addition results in delignification and brightening benefits which are greater than when either oxygen or sodium hypochlorite, or oxygen and hydrogen peroxide, are used separately. In other words, as will be seen by reference to the experimental results reported in the examples which follow, an unanticipated synergistic effect is observed. And, furthermore, in the case of sodium hypochlorite no additional viscosity losses are incurred over the use of an oxygen alkaline extraction stage.

The oxygen and the sodium hypochlorite, or the oxygen and the hydrogen peroxide, can be incorporated into the pulp by one of several means, including a high shear mixer, a static mixer, a refiner or a medium consistency pump.

The alkaline extraction stage can take place in a conventional tower used for extraction or in a pressurized vessel such as a digester, and it can be conducted under a constantly declining pressure head, as disclosed by Roymoulik and Brown in U.S. Pat. No. 3,832,276, the disclosure of which is incorporated herein by reference, or by applying a constant partial pressure of oxygen to the pulp.

Alternatively, the sodium hypochlorite or the hydrogen peroxide can be added immediately prior to the oxygen-alkaline extraction stage. In this mode, the sodium hypochlorite or hydrogen peroxide is conveniently added at the repulper, at the last shower bar of the chlorination stage washer or at any other convenient location prior to the addition of oxygen, and the pulp residence time in the steam mixer is from less than about one minute to about three minutes or somewhat more. Furthermore, in this mode of addition a portion, but not all, of the sodium hypochlorite or hydrogen peroxide applied is consumed before the oxygen-alkaline extraction stage and thus sodium hypochlorite or hydrogen peroxide, as such, is present during the extraction per se.

After completion of the extraction stage, the pulp is washed and then bleached further by any of a variety of sequences having one or more stages. The number and type of stages employed subsequent to extraction are dependent upon whether the pulp is a hardwood or a softwood, the brightness level which is desired to be attained, and the type and amount of bleachant chemicals employed. Exemplary post-extraction stages sequence are: D, DED, (hD), HD, HDED or (hD)ED. It has been shown experimentally, as will be seen hereafter by reference to Examples 2 and 3, that employing a separate hypochlorite stage after the extraction stage is particularly advantageous when bleaching hardwood pulp.

In order to disclose more clearly the nature of the present invention, the following examples illustrating the invention are given. It should be understood, however, that this is done solely by way of example, and is intended neither to delineate the scope of the invention nor limit the ambit of the appended claims.

EXAMPLE 1

A typical southern softwood kraft pulp (4×1200 oven dry grams,), with an initial lignin content expressed in Kappa number units corresponding to 34.3, was chlorinated with a mixture containing 7.64% chlorine, 0.22% chlorine dioxide, and sufficient water to provide a final consistency corresponding to 3.0%. The chlorination stage was performed at 40° C. for 40 minutes. Subsequently, each of the four portions was thoroughly washed, pressed to a consistency of approximately 30% solids, and comminuted into fiber and fiber aggregates.

The first portion (henceforth $C_DE$ pulp) was diluted with water and sufficient 1.0N sodium hydroxide solution to provide a final consistency corresponding to 10% solids and an amount of sodium hydroxide corresponding to 3.29% of the total oven dry weight of pulp. The pulp mixture was charged into a 10 gallon Pfaudler reactor, heated to 70° C., mixed with mechanical agitation, and held at 70° C. for 60 minutes. At the end of one hour the pulp was diluted to less than 1% consistency, drained, rediluted to less than 1% consistency, and pressed to approximately 30% solids.

The second portion (henceforth $C_D$(hE)) was treated similarly to the $C_D$E variant above, except that 3.39% sodium hydroxide and 0.3% sodium hypochlorite (calculated on an active chlorine basis) were used.

The third portion (henceforth $C_DE_o$ pulp) was treated similarly to the $C_D$E variant except that 3.39% sodium hydroxide was used and an initial pressure of 40 psig gaseous oxygen was applied. Also, the $C_DE_o$ variant was treated in such a manner that a pressure relief schedule corresponding to a 4 psig drop every 6 minutes was followed in order to simulate upward flow in a commercial extraction stage as carried out in a conventional upflow extraction tower.

Last, the fourth portion of chlorinated pulp (henceforth $C_D$(h$E_o$) pulp) was treated similarly to the $C_DE_o$ variant, including the pressure relief schedule, except that both 40 psig gaseous oxygen and 0.3% sodium hypochlorite were applyed simultaneous with the sodium hydroxide/water solution.

TABLE 1

| Variant | Permanganate No. | % GE Brightness | 0.5% CED Viscosity |
|---|---|---|---|
| $C_D$E | 3.62 | 33.8 | 30.9 |
| $C_D$(hE) | 3.47 | 34.5 | 30.8 |
| $C_DE_o$ | 3.07 | 37.4 | 29.3 |
| $C_D$(h$E_o$) | 2.85 | 39.0 | 29.4 |

Table 1 depicts the results of the analyses on the aforementioned variants from which it is apparent that the $C_D$(hE) sequence produces a small but measurable decrease in lignin content and an increase in brightness compared to $C_D$E pulp. Similarly, the $C_DE_o$ process yields pulp having greater delignification and brightening than $C_D$(hE) pulp, and much lower lignin content and greater brightness than that of $C_D$E pulp. Also, it is apparent that in both cases, $C_DE_o$ and $C_D$(hE), pulp viscosity is decreased by small but measurable amounts compared to the conventional $C_D$E pulp viscosity. However, the results of the $C_D$(h$E_o$) experiment clearly indicate that the combined effects of oxygen and sodium hypochlorite in the first extraction stage exceed those found for either of the individual treatments, and exceed that which is predictable by the simple additive effects of either $C_D$(hE) or $C_DE_o$.

For example, the use of 0.3% sodium hypochlorite alone, i.e., $C_D$(hE), resulted in pulp having a permanganate number and brightness corresponding to 3.47 and 34.5% GE, respectively; these amount to a 4.1% decrease in lignin content and a 0.70% increase in brightness, respectively, compared to CE-pulp. In the case of $C_DE_o$-pulp, the degree of delignification and brightening compared to CE-pulp amounts to 15.2% and 3.6% GE, respectively. However, in the case of $C_D$(h$E_o$) pulp, delignification and brightening amounted to 21.3% and 5.2% GE, respectively, which exceeds the sum of the results from (hE) and $E_o$, namely, 21.3% vs 15.2%+4.1% and 5.2% GE vs 3.6% GE+0.70% GE). Moreover, the $C_D$(h$E_o$) pulp viscosity of 29.4 cps reflected an improved viscosity over the 29.3 cps in $C_DE_o$ sequence.

EXAMPLE 2

A typical southern hardwood kraft pulp (1475 od grams) having a lignin content corresponding to 16.5 Kappa, was chlorinated with a mixture containing 3.14% chlorine and 0.1% chlorine dioxide at 40° C. and 3% consistency for 40 minutes. Subsequently, the chlorinated pulp was washed thoroughly, pressed to a consistency of approximately 30% solids, comminuted to fiber and fiber aggregates and divided into four equal portions, denoted as A, B, C and D.

Portion A was diluted with water and sufficient sodium hydroxide to provide a final consistency corresponding to 10% solids and an amount of sodium hydroxide corresponding to 1.41% of the total oven-dry weight of pulp. The pulp mixture was charged into a 10 gallon Pfaudler reactor, pressurized with gaseous nitrogen to 40 psig to simulate the hydrostatic head pressure of an extraction tower 80 feet in height, heated to 70° C., with mechanical agitation, and held at this temperature for a period of one hour. During the prescribed retention time, a pressure relief schedule amounting to a 4 psig decrease every 6 minutes was followed in order to simulate upward pulp flow in a commercial extraction stage. At the end of one hour, as measured from the time when the temperature reached 70° C. and the pressure reached 40 psig, the pulp was diluted to less than 1% consistency, drained, rediluted to less than 1% consistency, and pressed to approximately 30% solids.

Portion B was treated similarly to Portion A, except that 0.4% sodium hypochlorite (as calculated on an active chlorine basis) was included in the sodium hydroxide-water mixture.

Portion C was treated similarly to Portion A, except that gaseous oxygen was substituted for nitrogen.

Portion D was treated similarly to Portion C, except that 0.4% sodium hypochlorite was also included. For convenience, Portions A, B, C and D will be referred to as $C_D$E, $C_D$(hE), $C_DE_o$ and $C_D$(h$E_o$), respectively.

TABLE 2

| | $C_D$E | $C_D$(hE) | $C_DE_o$ | $C_D$(h$E_o$) |
|---|---|---|---|---|
| Tappi P No. | 2.64 | 2.43 | 2.32 | 2.11 |
| GE Brightness | 36.8 | 41.4 | 40.8 | 45.7 |
| Viscosity | 19.7 | 19.6 | 19.0 | 19.0 |

From Table 2 above it is readily apparent that of the four pulps described the $C_D$(h$E_o$) variant has the lowest permanganate number, highest brightness and a viscosity which is equivalent to that of its $C_DE_o$ counterpart. In this case brightness increased and the prevention of viscosity loss improved to an extent which would not be predictable from individual brightness increases and viscosity losses of the $C_D$(hE) or $C_DE_o$ pulps.

TABLE 3

| | Post Extraction Hypochlorite Stage Trials | | | | | | | | | | | |
|---|---|---|---|---|---|---|---|---|---|---|---|---|
| | $C_D$E | | | $C_D$(hE) | | | $C_DE_o$ | | | $C_D$(h$E_o$) | | |
| % Hypochlorite | 0.7 | 0.9 | 1.1 | 0.6 | 0.8 | 1.0 | 0.5 | 0.7 | 0.9 | 0.3 | 0.5 | 0.7 |
| % NaOH | 0.25 | 0.32 | 0.40 | 0.225 | 0.30 | 0.375 | 0.25 | 0.30 | 0.38 | 0.20 | 0.25 | 0.30 |

TABLE 3-continued

| | Post Extraction Hypochlorite Stage Trials | | | | | | | | | | | |
|---|---|---|---|---|---|---|---|---|---|---|---|---|
| | $C_DE$ | | | $C_D(hE)$ | | | $C_DE_o$ | | | $C_D(hE_o)$ | | |
| pH Off | 8.9 | 9.1 | 9.7 | 9.5 | 9.5 | 9.8 | 9.4 | 9.5 | 9.6 | 9.7 | 9.5 | 9.3 |
| GE Brightness | 64 | 68 | 71 | 65 | 69 | 72 | 62 | 68 | 72 | 59 | 66 | 71 |
| Visc. (0.5% CED) | 16.6 | 13.6 | 11.9 | 16.4 | 13.4 | 11.6 | 17.4 | 15.9 | 12.3 | 18.6 | 16.6 | 13.9 |

Table 3 points out the benefits to be obtained with a $C_D(hE_o)$ bleaching sequence and the advantage it offers over the prior art are especially evident when one considers the results from a post extraction hypochlorite stage, employing sodium hypochlorite and sodium hydroxide, on the four pulps described above.

For example, at roughly equivalent GE brightness (71–72%), the $C_D(hE_o)$ variant has higher viscosity than either the $C_DE$, $C_D(hE)$ or $C_DE_o$ variants. The foregoing phenomenon is especially unexpected and surprising since the $C_D(hE_o)$ variant used the same total active chlorine (as sodium hypochlorite) to reach 71% GE brightness as did the $C_DE$ variant, and a greater quantity of total active chlorine than the $C_DE_o$ variant, yet the final viscosity is about 1.6 to 2.0 cps greater for $C_D(hE_o)$.

EXAMPLE 3

During a period of continuous operation, an unbleached southern hardwood kraft pulp with an average permanganate number and viscosity corresponding to 12.5 and 25.7 cps, respectively, was chlorinated at an average consistency and temperature corresponding to 3.3% and 38° C. using a mixture containing 3.9% chlorine and 0.2% chlorine dioxide based on the oven dry weight of pulp. Subsequently, caustic extraction was performed in a continuous manner at an average consistency and temperature of 11.3% and 64° C. using 2.8% sodium hydroxide. This resulted in a $C_DE$-pulp with the following properties: 3.50 permanganate number, 34% brightness (GE), and 21.2 cps viscosity.

During another period of continuous operation, a southern hardwood kraft pulp similar to that described above, i.e., 13.6 permanganate number and 24.5 cps, was chlorinated and extracted in a similar manner except that an average of 0.4% oxygen was used in the extraction stage. This resulted in $C_DE_o$ pulp with the following properties: 2.87 permanganate number, 41.6% GE brightness, and 18.1 cps viscosity.

During a third period of continuous operation, a southern hardwood pulp similar to those described previously, i.e. 13.2 permanganate number and 24.9 cps viscosity, was chlorinated and extracted in a manner similar to that described for the $C_DE_o$ pulp, except that an average of 0.29% sodium hypochlorite was included on the chlorinated pulp at the chlorination washer repulper prior to the $E_o$ extraction. This produced a $C_D(hE_o)$ pulp with the following properties: 1.96 permanganate number, 47.5% GE brightness, and 18.1 cps viscosity.

Upon subsequent hypochlorination of the three pulps described above in a separate bleaching stage using an average of 1.13% hypochlorite on $C_DE$-pulp, 1.05% on $C_DE_o$-pulp and 0.97% on $C_D(hE_o)$ pulp, the average pulp properties depicted in Table 4 were observed. The advantages of using the $C_D(hE_o)$ process are immediately apparent based on substantial brightness increases and remarkably improved viscosity.

TABLE 4

| | % NaOCl | Brightness (GE) | Viscosity, cps (0.5% CED) |
|---|---|---|---|
| $C_DE$ | 1.13 | 68.0 | 13.8 |
| $C_DE_o$ | 1.05 | 69.4 | 12.9 |
| $C_D(hE_o)$ | 0.97 | 73.5 | 13.9 |

EXAMPLE 4

During a period of continuous operation, an unbleached southern softwood kraft pulp with an average permanganate number and viscosity corresponding to 22.5 and 29.4 cps, respectively, was chlorinated at an average consistency and temperature corresponding to 3.0% and 33° C. using a mixture containing 8.6% chlorine and 0.1% chlorine dioxide based on the oven dry weight of pulp. Subsequently, caustic extraction was performed in a continuous manner at an average consistency and temperature of 9.9% and 62° C. using 4.5% sodium hydroxide. This resulted in a $C_DE$-pulp with the following properties: 5.31 permanganate number, 24.0% brightness (GE), and 25.0 cps viscosity.

During another period of continuous operation, a southern softwood kraft pulp similar to that described above and having a 22.8 permanganate number and 25.8 cpc viscosity was chlorinated and extracted in a similar manner except that 0.6% oxygen was used in the extraction stage. This resulted in a $C_DE_o$ pulp with the following properties: 4.47 permanganate number, 26.5% brightness (GE), and 22.8 cps viscosity. During a third period of continuous operation, a southern softwood kraft pulp similar to those described previously and having a 22.9 permanganate number and 25.2 cps viscosity was chlorinated and extracted in a manner similar to the $C_DE_o$-process, except that an average of 0.3% hypochlorite was included on the chlorinated pulp at the chlorination washer repulper prior to the $E_o$ extraction. This resulted in a $C_D(hE_o)$ pulp with the following properties: 3.28 permanganate number, 32.8% brightness, are 22.4 cps viscosity.

For comparison purposes, a sample of pulp was obtained from the system prior to the injection of oxygen and held at constant temperature for a period corresponding to the retention time in the extraction tower, which was approximately 60 minutes. This pulp sample corresponds to the $C_D(hE)$ variant and had the following properties: 4.23 permanganate number 26.6% brightness (GE), and 22.6 cps viscosity.

It is apparent that the synergism between hypochlorite and oxygen produced a $C_D(hE_o)$ pulp with delignification and brightness greater than that which would be expected from the individual effects of $E_o$ and (hE), which demonstrates convincingly that the process of the present invention is selective in its removal of lignin without sacrificing viscosity.

TABLE 5

| | Permanganate No. | % Brightness (GE) | Viscosity, cps (0.5% CED) |
|---|---|---|---|
| $C_DE$ | 5.31 | 24.0 | 25.0 |
| $C_DE_o$ | 4.47 | 26.5 | 22.8 |
| $C_D$(hE) | 4.23 | 26.6 | 22.6 |
| $C_D$(h$E_o$) | 3.28 | 32.8 | 22.4 |

EXAMPLE 5

A typical northern hardwood kraft pulp (4000 g od) having a lignin content corresponding to 15.4 Kappa, was chlorinated with a mixture containing 2.46% chlorine and 0.1% chlorine dioxide (based on the oven dry weight of pulp), at 45° C. and 1.8% consistency for 30 minutes. Subsequently, the chlorinated pulp was washed thoroughly, pressed to a consistency of approximately 30% solids, comminuted to fiber and fiber aggregates and divided in six equal portions denoted as A, B, C, D, E and F.

Portion A was diluted with water and sufficient sodium hydroxide to provide a final consistency corresponding to 10% solids and an amount of sodium hydroxide corresponding to 1.35% of the total oven-dry weight of pulp. The pulp mixture was charged into a 10 gallon Pfaudler reactor, pressurized with gaseous nitrogen to 45 psig, heated to 65° C., mixed with mechanical agitation, and held at this temperature for a period of 75 minutes. During the prescribed retention time, a pressure relief schedule amounting to 3 psig every minute was imposed resulting in atmospheric pressure within the reactor at the end of 15 minutes. Upon completing the extraction, the pulp was diluted to less than 1% consistency, drained, rediluted to less than 1% consistency, and pressed to approximately 30% solids.

Portion B was treated in a manner similar to Portion A, except that gaseous oxygen was substituted for nitrogen and 1.55% NaOH was applied to the pulp.

Portion C was treated in a manner similar to Portion A, except that 0.4% sodium hypochlorite was included in sodium hydroxide-water mixture, and 1.55% NaOH was applied to the pulp.

Portion D was treated in a manner similar to Portion C, except that gaseous oxygen was substituted for nitrogen.

Portion E was treated in a manner similar to Portion C, except that 0.2% hydrogen peroxide was used instead of sodium hypochlorite.

Portion F was treated in a manner similar to Portion E, except that gaseous oxygen was substituted for nitrogen. For convenience, Portions A through F will be referred to as $C_DE$, $C_DE_o$, $C_D$(hE), $C_D$(h$E_o$), $C_D$(pE) and $C_D$(p$E_o$), respectively.

TABLE 6

| | $C_DE$ | $C_DE_o$ | $C_D$(hE) | $C_D$(h$E_o$) | $C_D$(pE) | $C_D$(p$E_o$) |
|---|---|---|---|---|---|---|
| Tappi P No. | 3.2 | 2.9 | 3.1 | 2.6 | 3.1 | 2.4 |
| GE Brightness | 44.2 | 47.0 | 44.5 | 50.9 | 48.7 | 53.3 |
| Viscosity | 27.7 | 26.0 | 25.9 | 26.7 | 27.2 | 24.9 |

From Table 6 above it is readily apparent that of the six pulps described, the $C_D$(p$E_o$) variant has the lowest permanganate number and highest brightness. Furthermore, the increase in brightness and decrease in permanganate number in the $C_D$(p$E_o$) variant are greater than those produced by $E_o$ or (pE) alone, and most significantly and unexpectedly, are greater than that which could be predicted by the additive effects of $E_o$ and (pE).

From Table 6 above it is also apparent that the $C_D$(h$E_o$) process produces a "synergistic" effect similar to that previously described resulting in lower permanganate number and higher brightness than that which could be predicted from the additive effects of $E_o$ and (hE). Moreover, the $C_D$(h$E_o$) process resulted in pulp having higher viscosity than either the $C_DE_o$ or $C_D$(hE) variants, an especially remarkable finding since the (h$E_o$) variant has a much lower permanganate number. That is, the $C_D$(h$E_o$) process is more selective in removing lignin than either of the individual processes of $E_o$ or hE.

The terms and expressions which have been employed are used as terms of description and not of limitation, and there is no intention in the use of such terms and expressions of excluding any equivalent of the features shown and described or any portions thereof, but it is recognized that various modifications are possible within the scope of the invention claimed.

What is claimed is:

1. A multi-stage bleaching process including at least one alkaline extraction stage for the bleaching and delignification of lignocellulosic pulp wherein the first alkaline extraction stage comprises extracting the pulp with caustic in the presence of from about 0.2 to about 1.0% oxygen, based on the oven-dry weight of the pulp, and from about 0.05% to about 1.0% of a hypochlorite, based on the oven-dry weight of the pulp, or from about 0.05% to about 1.0% of a peroxide, based on the oven-dry weight of the pulp.

2. A process in accordance with claim 1 wherein a hypochlorite is employed.

3. A process in accordance with claim 2 wherein the hypochlorite is sodium hypochlorite.

4. A process in accordance with claim 3 wherein from about 0.05% to about 0.5% of sodium hypochlorite is applied, based on the oven-dry weight of the pulp.

5. A process in accordance with claim 3 wherein the sodium hypochlorite is applied to the pulp prior to the addition of oxygen.

6. A process in accordance with claim 1 wherein a peroxide is employed.

7. A process in accordance with claim 6 wherein the peroxide is hydrogen peroxide.

8. A process in accordance with claim 7 wherein from about 0.05% to about 0.5% of hydrogen peroxide is applied, based on the oven-dry weight of the pulp.

9. A process in accordance with claim 7 wherein the hydrogen peroxide is applied to the pulp prior to the addition of oxygen.

10. A process in accordance with claim 1 and including a stage selected from D, H or (hD) immediately following the first alkaline extraction stage.

11. A sequential multi-stage process for the bleaching and delignification of lignocellulosic pulp, which comprises:

(a) treating the lignocellulosic pulp with oxygen, ozone, peroxide, chlorine, chlorine dioxide, or mixtures of chlorine and chlorine dioxide, in an initial stage;

(b) extracting the pulp with caustic in the presence of from about 0.2 to about 1.0% of oxygen, based on the oven-dry weight of the pulp, and from about 0.05% to about 1.0% of a hypochlorite, based on the oven-dry weight of the pulp, or from about 0.05% to about 1.0% of a peroxide, based on the oven-dry weight of the pulp in a first alkaline extraction stage.

12. A process in accordance with claim 11 wherein a hypochlorite is employed.

13. A process in accordance with claim 11 wherein the hypochlorite is sodium hypochlorite.

14. A process in accordance with claim 13 wherein from about 0.05% to about 0.5% of sodium hypochlorite is applied, based on the oven-dry weight of pulp.

15. A process in accordance with claim 11 wherein a peroxide is employed.

16. A process in accordance with claim 15 wherein the peroxide is hydrogen peroxide.

17. A process in accordance with claim 16 wherein from about 0.05% to about 0.5% of hydrogen peroxide is applied, based on the oven-dry weight of the pulp.

18. A process in accordance with claim 11 and including a stage selected from D, H or (hD) immediately following the first alkaline extraction stage.

19. A sequential multi-stage process for the delignification and bleaching of lignocellulosic pulp, which comprises:

(a) delignifying the lignocellulosic pulp with oxygen;

(b) treating the pulp with chlorine, chlorine dioxide, or mixtures thereof;

(c) extracting the pulp with caustic in the presence of from about 0.2 to about 1.0% of oxygen, based on the oven-dry weight of the pulp, and from about 0.05% to about 1.0% of a hypochlorite, based on the oven-dry weight of the pulp, or from about 0.05% to about 1.0% of a peroxide, based on the oven-dry weight of the pulp in a first alkaline extraction stage.

20. A process in accordance with claim 19 wherein a hypochlorite is employed.

21. A process in accordance with claim 20 wherein the hypochlorite is sodium hypochlorite.

22. A process in accordance with claim 21 wherein from about 0.05% to about 0.5% of sodium hypochlorite is applied, based on the oven-dry weight of the pulp.

23. A process in accordance with claim 19 wherein a peroxide is employed.

24. A process in accordance with claim 23 wherein the peroxide is hydrogen peroxide.

25. A process in accordance with claim 24 wherein from about 0.05% to about 0.5% of hydrogen peroxide is applied, based on the oven-dry weight of the pulp.

26. A process in accordance with claim 11 and including a stage selected from D, H or (hD) immediately following the first alkaline extraction stage.

* * * * *

US004568420B1

REEXAMINATION CERTIFICATE (3741st)

United States Patent [19]

Nonni

[11] B1 4,568,420

[45] Certificate Issued Mar. 2, 1999

[54] MULTI-STAGE BLEACHING PROCESS INCLUDING AN ENHANCED OXIDATIVE EXTRACTION STAGE

[75] Inventor: Arthur J. Nonni, River Edge, N.J.

[73] Assignee: International Paper Company, New York, N.Y.

Reexamination Requests:

No. 90/001,554, Jul. 14, 1988
No. 90/001,669, Dec. 15, 1988
No. 90/001,772, May 15, 1989

Reexamination Certificate for:

| | |
|---|---|
| Patent No.: | **4,568,420** |
| Issued: | **Feb. 4, 1986** |
| Appl. No.: | **677,657** |
| Filed: | **Dec. 3, 1984** |

[51] Int. Cl.[6] ..... D21C 9/14; D21C 9/147; D21C 9/16

[52] U.S. Cl. ..... 162/65; 162/78; 162/89; 162/90

[58] Field of Search ..... 162/88, 89, 65, 162/78, 90

[56] References Cited

U.S. PATENT DOCUMENTS 3,719,552 3/1973 Farley et al. ..... 162/65

FOREIGN PATENT DOCUMENTS 58-501383 3/1983 Japan .
59-204996 11/1984 Japan .

OTHER PUBLICATIONS

Liebergott et al, "Oxidative Bleaching—A Review"; Paper presented at 69th Annual Meeting Tech Sect., Feb. 1 & 2 1983; Montreal, CAN.

Franzreb and Klein, "Use of the Oxygen Extraction Stage at Schwabische Zellstoff AG"; vol. 56 Schriftenreihe des Vereins fu Wasser–Boden– und Lufthygiene [Publication Series of the Water, Soil and Air Hygiene Association], Oct. 24, 1983, pp. 27–36.

Chang, H. and Gratzl, J.S., "Ring Cleavage Reactions Of Lignin Models With Oxygen And Alkali," Chemistry of Delignification With Oxygen, Ozone And Peroxides, Uni Publishers, pp. 151–163 (1980), presented at Raleigh, N.C., May 27–29, 1975.

Japanese Paper and Pulp Technology Association, Summary of Lectures of Annual Meeting of Oct. 17, 1984, pp. 96–102, and translation.

*Primary Examiner*—Steve Alvo

[57] ABSTRACT

A multi-stage process for the delignification and bleaching of lignocellulosic pulp is disclosed wherein the first alkaline extraction stage comprises extracting the pulp with caustic in the presence of oxygen and either a hypochlorite or a peroxide.

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–26 are cancelled.

* * * * *